US006519803B2

(12) United States Patent
Keller

(10) Patent No.: US 6,519,803 B2
(45) Date of Patent: Feb. 18, 2003

(54) CHIMNEY VACUUM SYSTEM

(76) Inventor: Thomas J. Keller, 6412 96th St. E., #20, Puyallup, WA (US) 98371

( * ) Notice: Subject to any disclaimer, the term of this patent is extended or adjusted under 35 U.S.C. 154(b) by 0 days.

(21) Appl. No.: 09/899,213

(22) Filed: Jul. 6, 2001

(65) Prior Publication Data

US 2003/0005543 A1 Jan. 9, 2003

(51) Int. Cl.[7] ..... A47L 9/02

(52) U.S. Cl. ..... 15/304; 15/395; 15/415.1; 15/421

(58) Field of Search ..... 15/304, 395, 415.1, 15/422, 421; 141/337, 340, 341, 342; 422/99, 101

(56) References Cited

U.S. PATENT DOCUMENTS

| | | | | |
|---|---|---|---|---|
| 1,371,468 A | | 3/1921 | Burges | 56/30 |
| 1,465,711 A | | 8/1923 | Gray | 134/21 |
| 1,979,873 A | | 11/1934 | Engstrom | 55/334 |
| 3,771,578 A | * | 11/1973 | Huff | 141/340 |
| 3,795,181 A | | 3/1974 | Lawson | 15/249.1 |
| 4,807,590 A | | 2/1989 | Evans | 15/314 |
| 4,964,921 A | * | 10/1990 | Lloyd | 15/304 |
| 5,311,637 A | | 5/1994 | Broussard | 15/301 |
| 5,979,516 A | * | 11/1999 | Grant | 141/340 |

FOREIGN PATENT DOCUMENTS

| | | |
|---|---|---|
| CA | 1 181 553 | 1/1985 |
| CA | 2 010 630 | 8/1991 |
| CA | 2 040 616 | 10/1992 |
| DE | 3529310 | 3/1987 |
| GB | 421664 | 5/1934 |
| GB | 622943 | 5/1949 |
| JP | 3102112 | 3/1991 |

* cited by examiner

*Primary Examiner*—Theresa T. Snider
(74) *Attorney, Agent, or Firm*—Richard C. Litman

(57) ABSTRACT

A chimney vacuum system having an adapter head for fluidly removing accumulated soot under vacuum pressure from a flue or chimney. The chimney vacuum system includes a hose adapted to the head via a frictional fit. The adapter head of the chimney system has a body portion which narrows in volume from an outer diameter to an inner diameter. Extending from the inner diameter is a neck portion for attaching an effluent hose and refuse container downstream. The body of the adapter head includes a sealing gasket defined therein for providing a mechanical and fluid seal with a flue mechanism element in the flow path of the flue.

6 Claims, 4 Drawing Sheets

CHIMNEY VACUUM SYSTEM

BACKGROUND OF THE INVENTION

1. Field of the Invention

The present invention relates generally to chimneys. More specifically, the invention is a funnel attachment for a chimney sweep vacuum which removes soot from a fireplace flue or work space without the need for tarps and the like to catch excavated soot spillage.

2. Description of the Related Art

The general use of particle removing apparatuses have been in existence as early as 1920. It was A. E. Burges (U.S. Pat. No. 1,371,468) who was credited with the idea of harvesting or removing cotton in its natural state by a suction based apparatus. This principle took root in the minds of others such as E. Gray (U.S. Pat. No. 1,465,711) and Engstrom (U.S. Pat. No. 1,979,873) which utilized suction channels for removing soot from furnaces in 1922 and 1933, respectively. As one might expect, these systems where often quite cumbersome to operate, and often include fixed mechanical attachments for limited use to clean up residual debris in difficult to reach areas. U.S. Pat. No. 3,795,181 issued to Lawson discloses a flue cleaning device as a fixed attachment to a flue housing. As described therein, a turbine is used having a plurality of discharge jets which discharge fluid within the housing to remove particles therefrom.

Later developments by Evans (U.S. Pat. No. 4,807.590) and Broussard (US) sought to provide a vacuum system as a portable device, but were met with mechanical limitations which inhibit the effective use of vacuum heads and the like in and around flue mechanisms of various sorts. Thus, a chimney vacuum system which is not messy, easy to use and which can be used in and around various flue mechanism or fixtures uninhibited is needed. Other patents granted to Clarkson et al. (GB 421,664), Newell (GB 622,943), Neuman (CA 1 181 55), Holter (DE 3529310), Seiji (JP 3102112), Asaph (CA 2010630) and Kupracz (CA 2040616) provided conventional chimney vacuum features which were face with the same limitations recited above, and thus are considered to be generally relevant to the invention as herein described.

None of the above inventions and patents, taken either singularly or in combination, is seen to describe the instant invention as claimed. Thus a chimney vacuum solving the aforementioned problems is desired.

SUMMARY OF THE INVENTION

The chimney vacuum system according to the invention includes an adapter head and hose assembly for quick and mess free removal of soot from interior rooms in residential and commercial buildings. The adapter is substantially conically shaped and has a neck portion for attaching an effluent or extension hose thereto. The shape of the adapter head is defined by an outer diameter which tapers in volume to an inner diameter which terminates a predetermined length to define a cylindrical channel or neck. The area defined between the outer diameter end and the inner diameter end forms the body of the adapter. Defined therein is a sealing gasket which forms conic section of predetermined area and distinct material properties (i.e rigidity, flexibility and expandability) from the body portion of the adapter head for providing a mechanical and fluid seal between at least one flue mechanism element such as a flue handle or the like.

The adapter is mechanically secured to an effluent hose at the neck for transporting contained flue soot under a vacuum from a work space to a remote location. The adapter is made as a single unitary structure with transparent plastic features for visually identifying soot removal. An excavation brush is used as another elemental feature of the system having tines or brush fibers which span the entire area of the flue to excavate and flush accumulated soot from the interior walls of the flue at selective heights within the chimney.

Accordingly, it is a principal object of the invention to provide a chimney vacuum system for removing accumulated soot from flues.

It is another object of the invention to provide a chimney vacuum system having an adapter which accommodates at least one chimney or flue mechanism without inhibiting an effective mechanical and fluid seal for removing accumulated soot from flues.

It is a further object of the invention to provide a chimney vacuum system which is simple to operate and deploy within interior rooms residential and commercial buildings.

Still another object of the invention is to provide a chimney vacuum system which minimizes dust and soot residue in a work space.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENT

Figure 1:
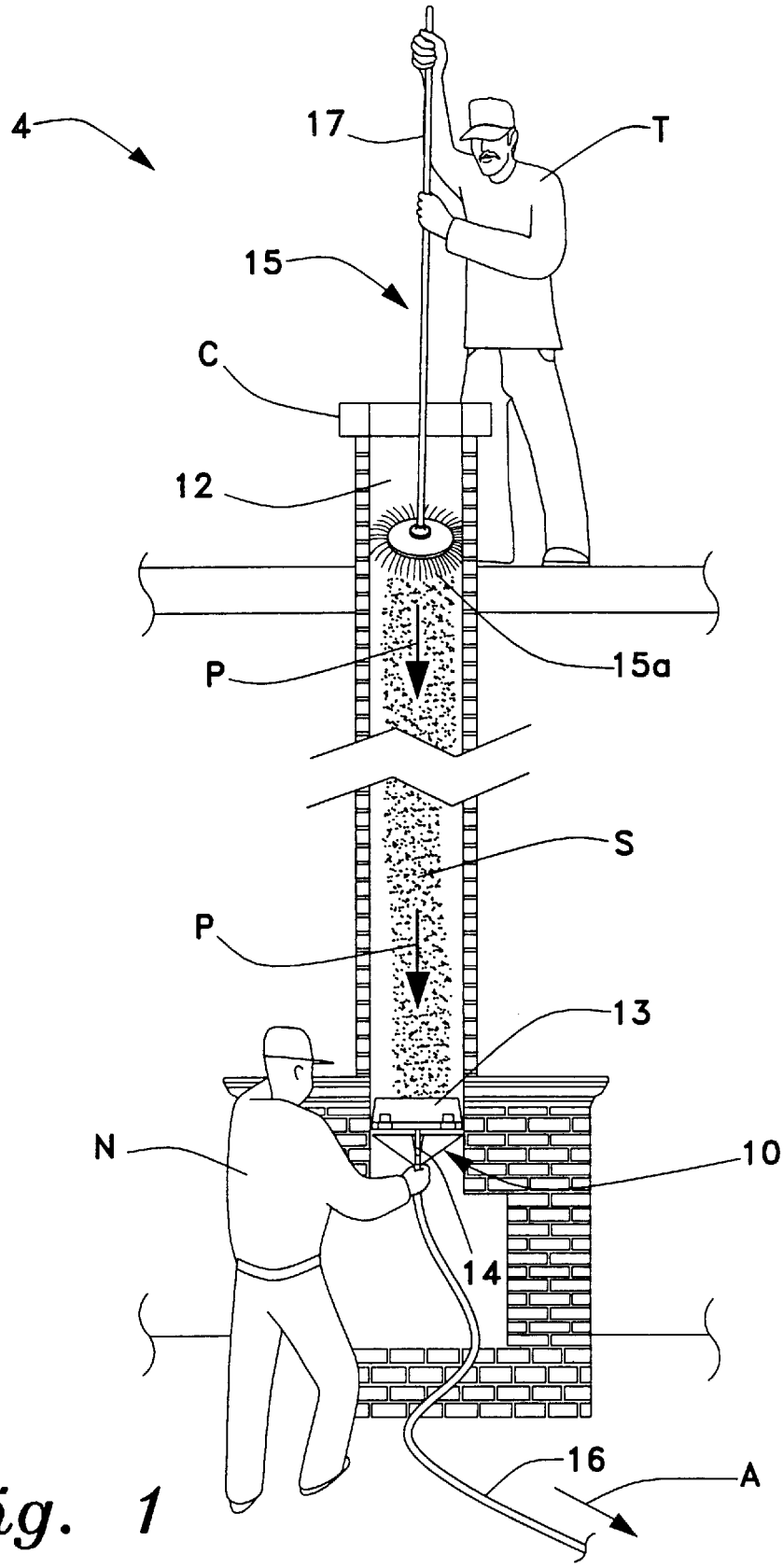
FIG. 1 is an environmental, perspective view of a chimney vacuum system according to the present invention.

The present invention is directed to a chimney vacuum adapter head and system for cleaning accumulated soot S from the flue of chimneys C. The preferred embodiment of the invention is depicted in FIGS. 1–3, and is generally referenced by numeral 4. The chimney adapter head of the system 4 is generally referenced by numeral 10.

As best seen in FIG. 1, the chimney vacuum system 4 is shown to illustrate the removal of accumulated soot S from a flue 12. The chimney adapter 10 is shown adapted to a flue mechanism 13 via a flue handle 14 at one end, and attached to an effluent hose 16 for soot or waste removal at another end via a frictional fit. This particular attachment provides a mechanical and fluid seal from the attachment point of the adapter head 10 with the flue mechanism 13 (via flue handle 14), and from the hose 16 fastened to the adapter 10 at another end to transport soot S under a vacuum to a remote refuse container (not shown). The refuse container for the chimney vacuum system 4 can be housed or contained within a van or similar vehicle to prevent soot S spillage within and around an interior portion of a home or room. The contained soot S can then be easily transported from a residence or work space to a remote area or landfill.

Accordingly, the vacuum head adapter 10 provides a peripheral seal at the mouth of the fireplace adjacent to the flue mechanism 13. The adapter head 10 is positioned and aligned within the airflow path P of the flue 12 for removing soot S therefrom. A single worker or technician T can demonstrate operative features of the system 4 (to a novice N) by using auxiliary fasteners to permanently fix the adapter 10 to a lower portion of the fire place and by ascending the roof to the top of the chimney to thrust a forcing means 15 from the top of the chimney into the flue 13 thereby agitating accumulated soot for free fall to the adapted lower vacuum head portion 10 of the system 4. The accumulated soot S is then transported to a refuse container housed in a remote location indicated by the direction arrow A. The forcing means 15 is preferably a spherical or substantially cylindrical wire brush 15 adapted for attachment to an elongated or telescoping handle 17 by conventional means (mechanical couplings or fasteners, etc.). The wire brush fibers 15*a* should extend to fill the span of the flue to provide frictional interface therebetween for the removal of soot and debris attached to the interior walls.

Figure 2A:
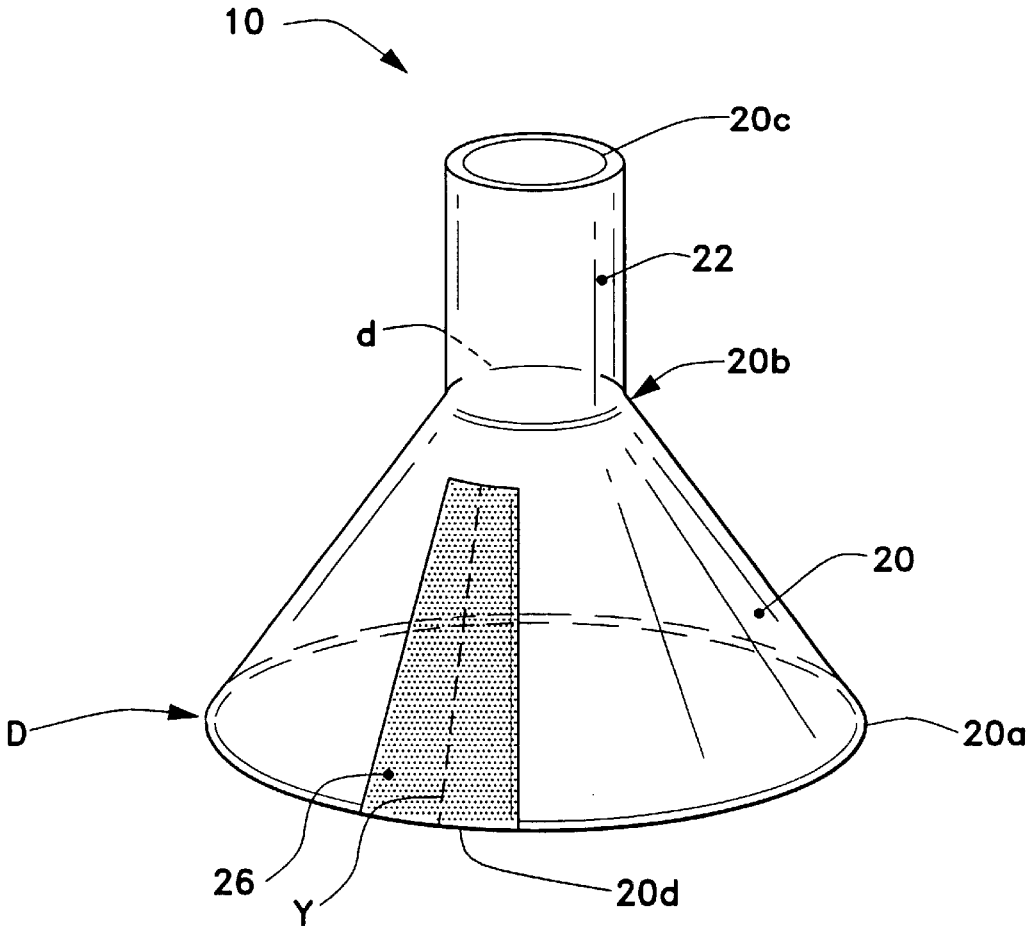
FIG. 2A is a perspective view of the vacuum adapter head of the vacuum system according to the invention.
Figure 2B:
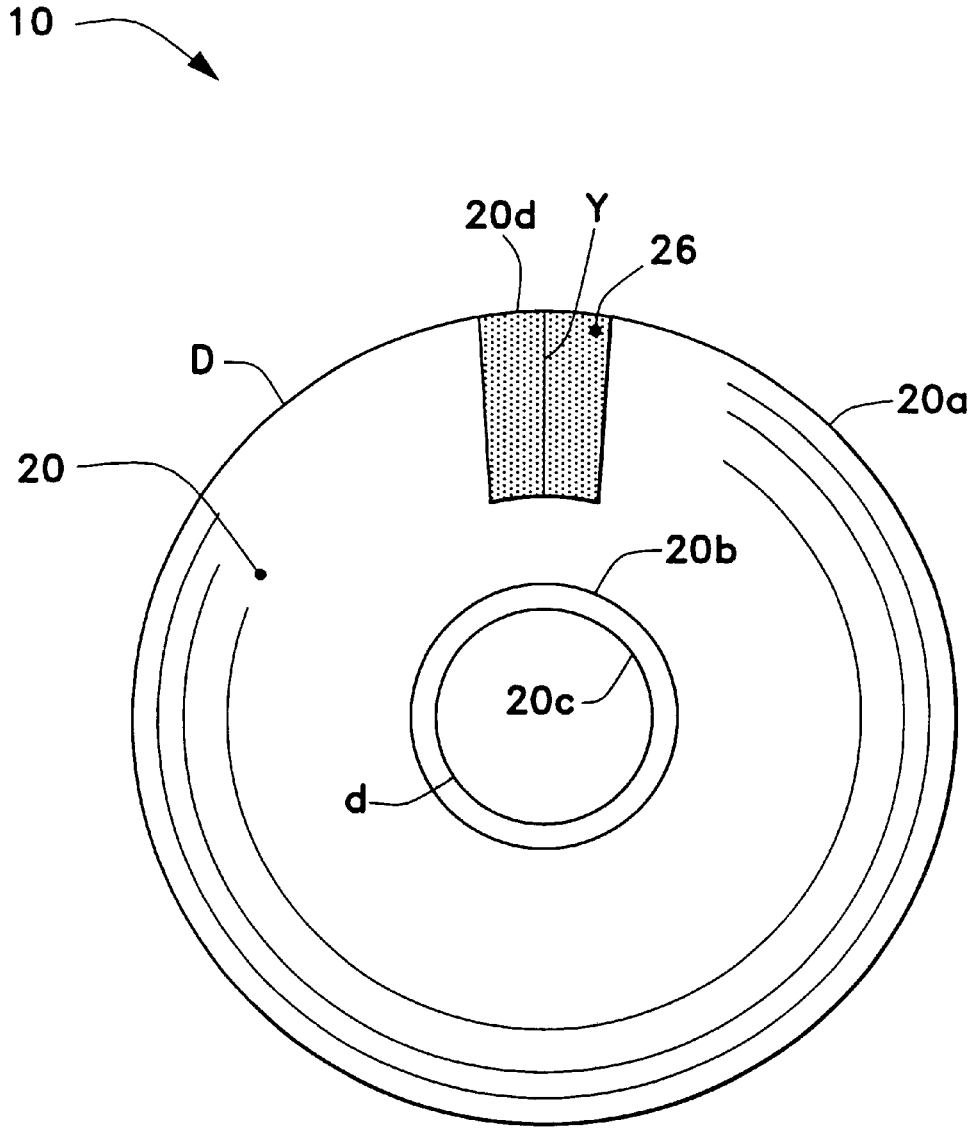
FIG. 2B is a top perspective view of the vacuum adapter head of FIG. 2A according to the invention.
Figure 3:
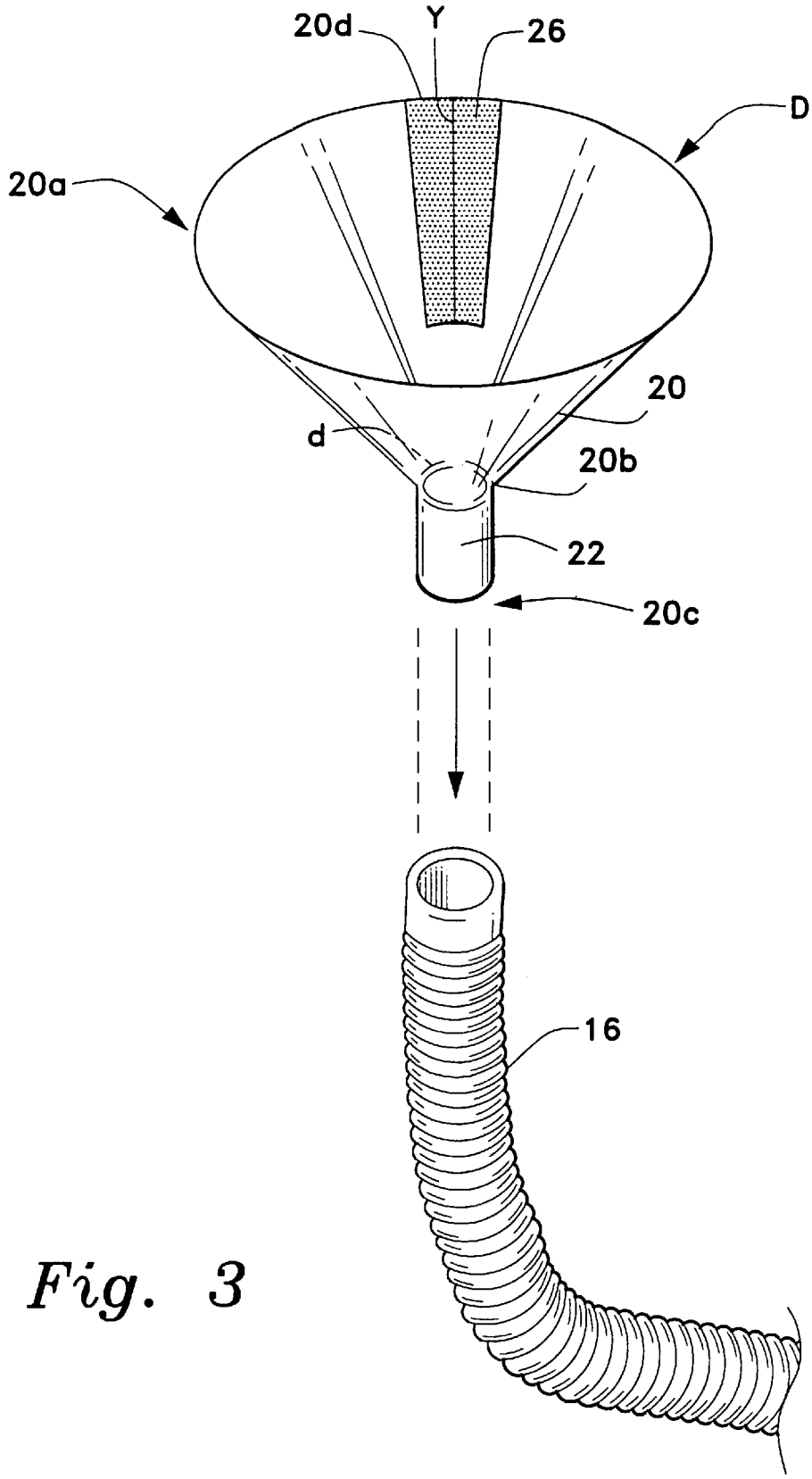
FIG. 3 is an exploded perspective of the vacuum adapter head of the vacuum system, illustrating hose and fastener connectivity Similar reference characters denote corresponding features consistently throughout the attached drawings.

As diagrammatically illustrated in FIGS. 2A and 2B, the adapter head 10 is shown in perspective view having a substantially conically shaped adapter head body portion 20 for a attachment with the lower portion of the chimney C. The adapter head 10 includes a neck portion 22. The body portion 20 comprises an outer diameter D at a first end 20*a* and an inner diameter d at a second end 20*b*. The outer diameter D being substantially larger than the inner diameter d, such that body portion 20 converges to define a smaller volume towards end 20*b* compared with the volume at end 20*a*. The neck portion 22 includes a terminal end 20*c* for adapting a hose 16 thereto. The neck portion 22 is preferably substantially cylindrical having a predetermined length 1 defined between the second and terminal ends 20*b* and 20*c*, respectively. The adapter head 10 further comprises a sealing means 26 disposed within a body portion 20 of the adapter 10 for fluidly sealing the body portion 20 of the adapter 10 around the handle 14 of a flue and/or air-flow control mechanism within the chimney C. The sealing means or gasket 26 preferably being made of a material having at least one material characteristic differing from the body and neck portions 20 and 22, respectively. The material characteristic consisting of at least one material characteristic such as rigidity, flexibility, or expandability. An exemplary illustration of this preferred feature includes wherein the gasket 26 is made of a rubber material and the body and neck portions 20, 22 of the adapter head 10 made of a hard plastic material.

While there are numerous material combinations or, permutations for the aforementioned description, the adapter 10 accordingly would comprise a gasket 26 which provides a mechanical and fluid seal to at least one chimney component or element of a flue mechanism therein. The at least one chimney component preferably being a flue handle 14. The gasket 26, then defines a conic section within the body portion 20 of the adapter head 10 of predetermined area. An area portion of the gasket 26 is preferably formed as a fixed attachment with at least one peripheral rim portion 20*d* defined by the outer diameter D of adapter head 10. The adapter head 10 is preferably made as single unitary structure 10. The method of manufacture can include an injection molding process. The area defined by the dotted line Y includes provisions for effecting an incision to form an insertable aperture to accommodate a flue handle 14 therebetween.

According to FIG. 3, the adapter head 10 is shown in an exploded perspective to illustrate lines of attachment to a effluent hose 16 via a frictional fit. Other beneficial features include wherein the adapter 10 is made of a transparent plastic material to provide a visual basis for the assurance of soot S removal.

It is to be understood that the present invention is not limited to the embodiment described above, but encompasses any and all embodiments within the scope of the following claims.

I claim:

1. An adapter for a chimney vacuum system comprising:

an adapter head having a substantially conically shaped portion and a tubular neck portion, said neck portion including a terminal end adapted for attachment to a vacuum hose; and sealing means integrally disposed within said adapter head for fluidly sealing at least one chimney component therein, said adapter head and said sealing means being made as a single unitary structure, wherein said sealing means defines a predetermined area within the conically shaped portion of said adapter head.

2. The adapter according to claim 1, wherein said adapter head and neck portion are made of a substantially rigid material, and said sealing means is made of a flexible material.

3. The adaptor according to claim 2, wherein said sealing means is a rubber gasket.

4. A chimney vacuum system for removing accumulate, soot from a chimney comprising:

soot forcing means for forcing soot from a top portion of a chimney to a lower portion of the chimney;

an adapter head including a substantially conically shaped portion for attachment to the lower portion of the chimney and a tubular neck portion having a terminal end adapted for attachment to a vacuum hose; and sealing means integrally disposed within said adapter head for fluidly sealing at least one chimney component therein, said adapter head and said sealing means being made as a single unitary structure, wherein said sealing means defines a predetermined area within the conically shaped portion of said adapter head.

5. The chimney vacuum system according to claim 4, wherein said adapter head and neck portion are made of a substantially rigid material, and said sealing means is made of a flexible material.

6. The chimney vacuum system according to claim 5, wherein said sealing means is a rubber gasket.

* * * * *